US006120173A

United States Patent [19]

Bonissone et al.

[11] Patent Number: 6,120,173

[45] Date of Patent: Sep. 19, 2000

[54] SYSTEM AND METHOD FOR PROVIDING RAW MIX PROPORTIONING CONTROL IN A CEMENT PLANT WITH A GRADIENT-BASED PREDICTIVE CONTROLLER

[75] Inventors: Piero Patrone Bonissone, Schenectady; Yu-To Chen, Niskayuna, both of N.Y.

[73] Assignee: General Electric Company, Schenectady, N.Y.

[21] Appl. No.: 09/189,152

[22] Filed: Nov. 9, 1998

[51] Int. Cl.[7] ..... B28C 7/06

[52] U.S. Cl. ..... 366/8; 366/16; 366/152.1; 700/265

[58] Field of Search ..... 366/16, 17, 8, 366/29, 2, 6, 140, 142, 152.1, 30, 33, 37; 700/265, 44, 45, 33

[56] References Cited

U.S. PATENT DOCUMENTS

| | | | |
|---|---|---|---|
| 3,048,335 | 8/1962 | Burhans et al. | 700/265 |
| 3,186,596 | 6/1965 | Badgett | 700/265 |
| 3,473,008 | 10/1969 | Bay et al. | 700/265 |
| 3,609,316 | 9/1971 | Brosset | 700/265 |
| 4,151,588 | 4/1979 | Hammer | 700/265 |
| 4,318,177 | 3/1982 | Rapp et al. | 700/265 |
| 4,701,838 | 10/1987 | Swinkels et al. | 700/44 |
| 5,320,425 | 6/1994 | Stephenson et al. | 366/1 |
| 5,452,213 | 9/1995 | Ito et al. | 366/8 |
| 5,590,976 | 1/1997 | Kilheffer et al. | 366/8 |
| 5,754,423 | 5/1998 | Teutenberg et al. | 700/28 |

FOREIGN PATENT DOCUMENTS

| | | | |
|---|---|---|---|
| 4-125108 | 4/1992 | Japan | 366/16 |
| 592454 | 2/1978 | U.S.S.R. | 366/16 |

*Primary Examiner*—Tony G. Soohoo

*Attorney, Agent, or Firm*—David C. Goldman; Jill M. Breedlove

[57] ABSTRACT

A system and method for providing raw mix proportioning control in a cement plant with a gradient-based predictive controller. A raw mix proportioning controller determines the correct mix and composition of raw materials to be transported to a mixer. The raw mix proportioning controller uses a gradient-based predictive controller to determine the proper mix and composition of raw materials. The gradient-based predictive controller takes targeted set points and the chemical composition of the raw material as inputs and generates the proportions of the raw material to be provided as an output for the next time step. The output is generated by using a non-linear constrained optimization.

16 Claims, 4 Drawing Sheets

SYSTEM AND METHOD FOR PROVIDING RAW MIX PROPORTIONING CONTROL IN A CEMENT PLANT WITH A GRADIENT-BASED PREDICTIVE CONTROLLER

BACKGROUND OF THE INVENTION

This invention relates generally to a cement plant and more particularly to providing raw mix proportioning control in a cement plant.

A typical cement plant uses raw material such as limestone, sandstone and sweetener to make cement. Transport belts (e.g. weighfeeders) transport each of the three raw materials to a mixer which mixes the materials together. A raw mill receives the mixed material and grinds and blends it into a powder, known as a "raw mix". The raw mill feeds the raw mix to a kiln where it undergoes a calcination process. In order to produce a quality cement, it is necessary that the raw mix produced by the raw mill have physical properties with certain desirable values. Some of the physical properties which characterize the raw mix are a Lime Saturation Factor (LSF), a Alumina Modulus (ALM) and a Silica Modulus (SIM). These properties are all known functions of the fractions of four metallic oxides (i.e., calcium, iron, aluminum, and silicon) present in each of the raw materials. Typically, the LSF, ALM and SIM values for the raw mix coming out of the raw mill should be close to specified set points.

One way of regulating the LSF, ALM and SIM values for the raw mix coming out of the raw mill to the specified set points is by providing closed-loop control with a proportional controller. Typically, the proportional controller uses the deviation from the set points at the raw mill as an input and generates new targeted set points as an output for the next time step. Essentially, the closed-loop proportional controller is a conventional feedback controller that uses tracking error as an input and generates a control action to compensate for the error. One problem with using the closed-loop proportional controller to regulate the LSF, ALM and SIM values for the raw mix coming out of the raw mill is that there is too much fluctuation from the targeted set points. Too much fluctuation causes the raw mix to have an improper mix of the raw materials which results in a poorer quality cement. In order to prevent a fluctuation of LSF, ALM and SIM values for the raw mix coming out of the raw mill, there is a need for a system and a method that can ensure that there is a correct mix and composition of raw materials for making the cement.

BRIEF SUMMARY OF THE INVENTION

In a first embodiment of this invention there is a system for providing raw mix proportioning control in a cement plant. In this embodiment, there is a plurality of raw material and a plurality of transport belts for transporting the material. A raw mix proportion controller, coupled to the plurality of raw material and the plurality of transport belts, controls the proportions of the raw material transported along the transport belts. The raw mix proportion controller comprises a gradient-based predictive controller that uses a plurality of target set points and the composition of the plurality of raw material as inputs and generates a control action to each of the plurality of transport belts that is representative of the proportions of the material to be transported along the belt. A mixer, coupled to the plurality of transport belts, mixes the proportions of each of the plurality of raw material transported therefrom.

In a second embodiment of this invention there is a method for providing raw mix proportioning control in a cement plant. In this embodiment, a plurality of raw material are transported with a plurality of transport belts to a mixer. Proportions of the plurality of raw material transported along the plurality of transport belts to the mixer are controlled by obtaining a plurality of target set points and the composition of the plurality of raw material. A gradient-based predictive control is performed on the plurality of target set points and the composition of the plurality of raw material. The proportions of the plurality of raw material transported along the plurality of transport belts to the mixer are determined according to the gradient-based predictive control. The determined proportions of the plurality of raw material are sent to the mixer for mixing.

DETAILED DESCRIPTION OF THE INVENTION

Figure 1:
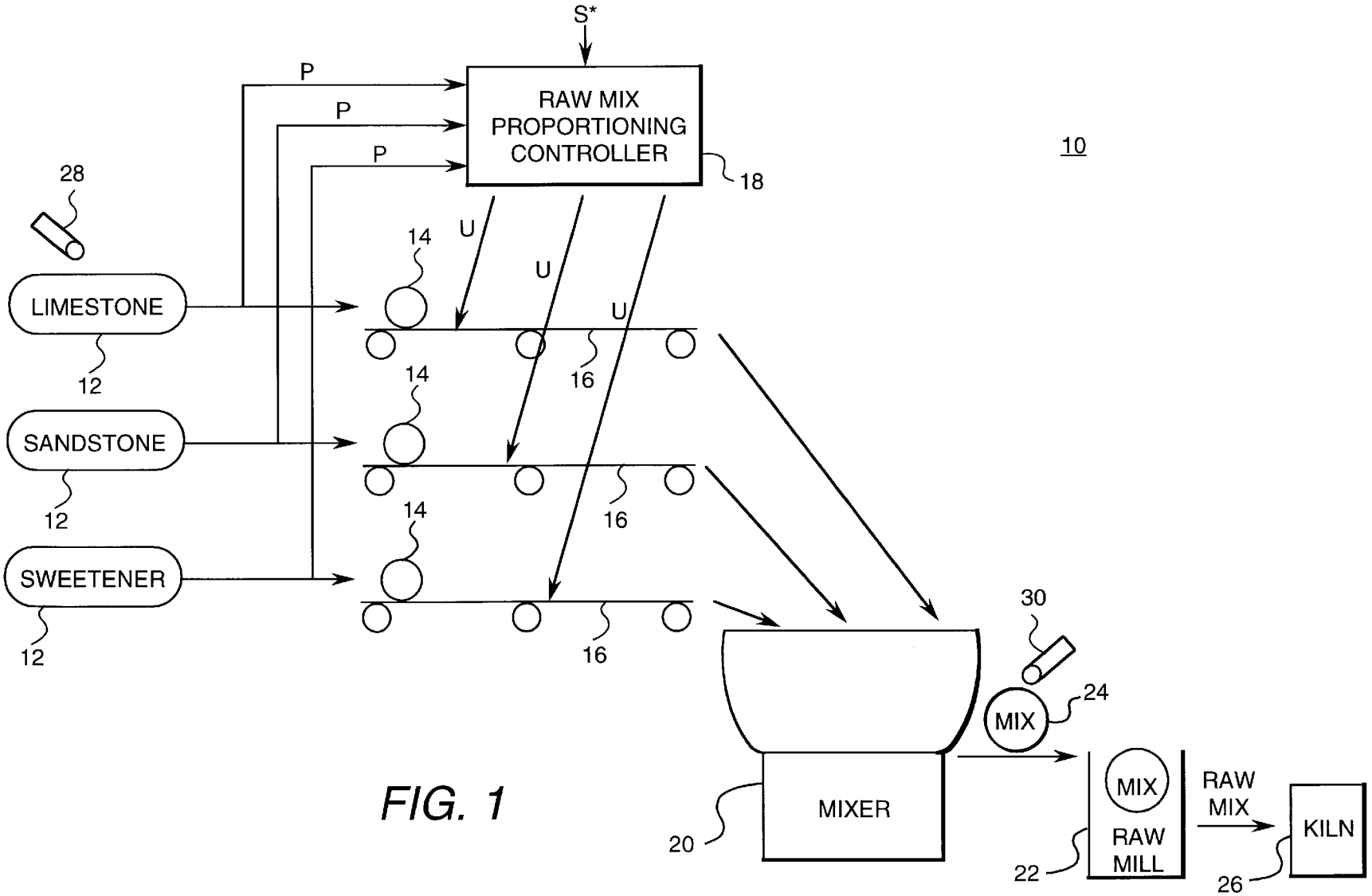
FIG. 1 shows a block diagram of a system for providing raw mix proportioning control in a cement plant according to this invention.

FIG. 1 shows a block diagram of a system 10 for providing raw mix proportioning control in a cement plant according to this invention. The raw mix proportioning control system 10 comprises a plurality of raw material 12 such as limestone, sandstone and sweetener to make cement. In addition, moisture can be added to the raw materials. While these materials are representative of a suitable mixture to produce a cement raw mix, it should be clearly understood that the principles of this invention may also be applied to other types of raw material used for manufacturing cement raw mix. Containers 14 of each type of raw material move along a transport belt 16 such as a weighfeeder. A raw mix proportioning controller 18 controls the proportions of each raw material 12 transported along the transport belts 16. A mixer 20 mixes the proportions of each raw material 12 transported along the transport belts 16. A raw mill 22 receives mixed material 24 from the mixer 20 and grinds and blends it into a raw mix. The raw mill 22 feeds the raw mix to a kiln 26 where it undergoes a calcination process.

As mentioned above, it is necessary that the raw mix produced by the raw mill 22 have physical properties with certain desirable values. In this invention, the physical properties are the LSF, ALM and SIM. These properties are all known functions of the fractions of four metallic oxides (i.e., calcium, iron, aluminum, and silicon) present in each of the raw materials. A sensor 28, such as an IMA QUARCON™ sensor, located at one of the transport belts 16 for conveying the limestone, measures the calcium, iron, aluminum and silicon present in the limestone. Those skilled in the art will recognize that more than one sensor can be used with the other raw materials if desired. Typically, the LSF, ALM and SIM values for the raw mix coming out of the raw mill should be close to specified target set points. Another sensor 30 such as an IMA IMACON™ sensor located before the raw mill 22 measures the calcium, iron, aluminum and silicon present in the mix 24. Although this invention is described with reference to LSF, ALM and SIM physical properties, those skilled in the art will recognize that other physical properties that characterize the raw mix are within the scope of this invention.

The raw mix proportioning controller 18 continually changes the proportions of the raw material 12 in which the material are mixed prior to entering the raw mill 22 so that the values of LSF, ALM and SIM are close to the desired set points and fluctuate as little as possible. The raw mix proportioning controller 18 uses gradient-based predictive control to continually change the proportions of the raw material. In particular, the gradient-based predictive control uses targeted set points and the chemical composition of the raw material as inputs and generates control actions to continually change the proportions of the raw material. The mixer 20 mixes the proportions of the raw material as determined by the gradient-based predictive control and the raw mill 22 grinds the mix 24 into a raw mix.

Figure 2:
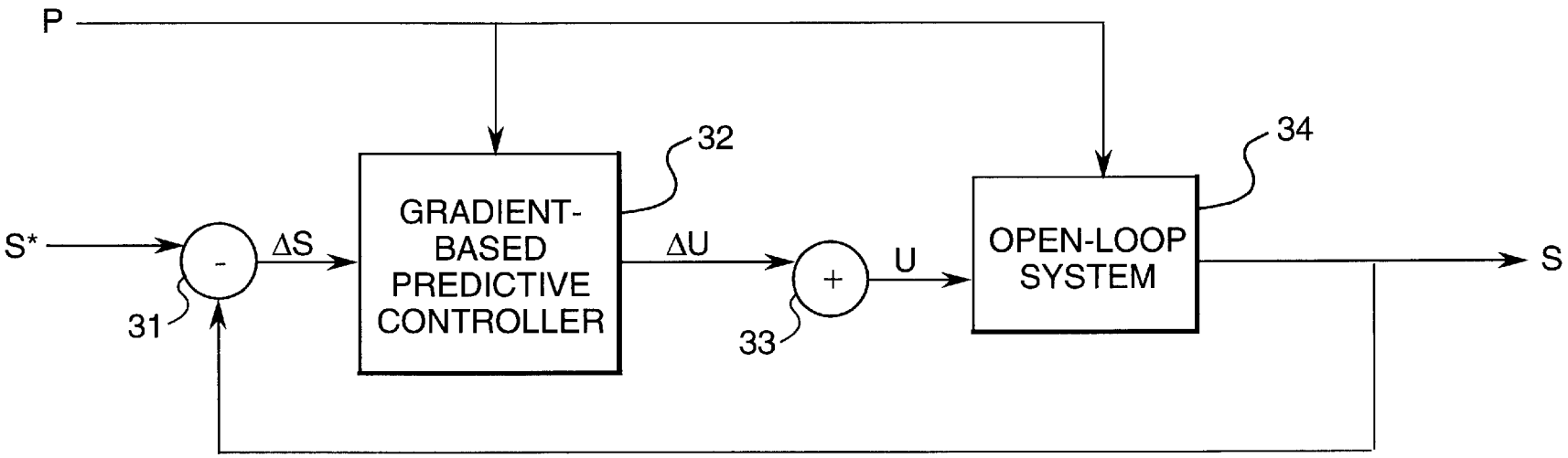
FIG. 2 shows a schematic of the gradient-based predictive control provided by the raw mix proportioning controller shown in FIG. 1 according to this invention.

FIG. 2 shows a schematic of the gradient-based predictive control provided by the raw mix proportioning controller 18. There are two main components to the gradient-based predictive control provided by the raw mix proportioning controller; a gradient-based predictive controller 32 and an open-loop system 34. The gradient-based predictive control takes S* and P as inputs and generates S as an output, where S* is the targeted set points, P is the process composition matrix, and S is the actual set points. A more detailed discussion of these variables is set forth below. At each time step, the gradient-based predictive control attempts to eliminate the tracking error, which is defined as;

$$\Delta S(t)=S^*-S(t) \tag{1}$$

by generating ΔU(t), the change in control action, which results in proper control action for the next time step which is defined as:

$$U(t+1)=\Delta U(t)+U(t) \tag{2}$$

More specifically, the gradient-based predictive controller 32 uses gradient information to produce change in control to compensate the tracking error. In FIG. 2, a subtractor 31 performs the operation of equation 1 and a summer 33 performs the operation of equation 2.

Figure 3:
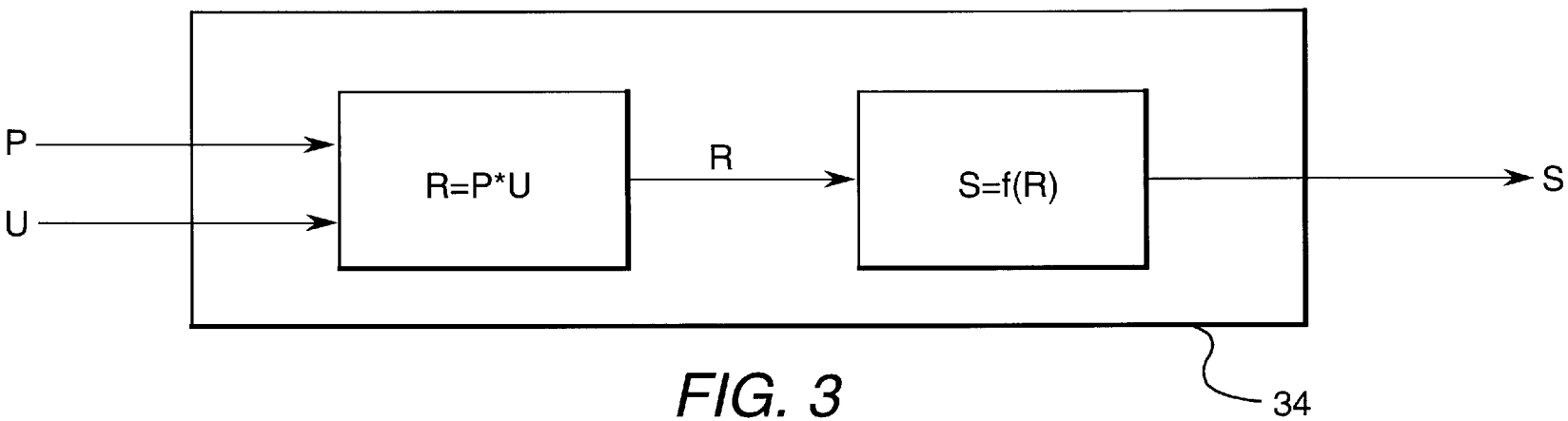
FIG. 3 shows a more detailed schematic of the open-loop system shown in FIG. 2.

FIG. 3 shows a more detailed diagram of the open-loop system 34 shown in FIG. 2. The open-loop system 34 receives P and U as inputs and generates S as an output, where P is a process composition matrix of size 4 by 3, U is a control variable matrix of size 3 by 1, S is the actual set point matrix of size 3 by 1, and R is a weight matrix of size 4 by 1.

The process composition matrix P represents the chemical composition (in percentage) of the input raw material (i.e., limestone, sandstone and sweetener) and is defined as:

$$P=\begin{bmatrix} c_1 & c_2 & c_3 \\ s_1 & s_2 & s_3 \\ a_1 & a_2 & a_3 \\ f_1 & f_2 & f_3 \end{bmatrix} \tag{3}$$

Column 1 in matrix P represents the chemical composition of limestone, while columns 2 and 3 in P represent sandstone and sweetener, respectively. This invention assumes that only column 1 in P varies over time, while columns 2 and 3 are considered constant at any given day. Row 1 in matrix P represents the percentage of the chemical element CaO present in the raw material, while rows 2, 3, and 4 represent the percentage of the chemical elements $S_iO_2$, $Al_2O_3$ and $Fe_2O_3$, respectively, present in the raw materials.

The control variable vector U represents the proportions of the raw material (i.e., limestone, sandstone and sweetener) used for raw mix proportioning. The matrix U is defined as:

$$U=\begin{bmatrix} u_1 \\ u_2 \\ u_3 \end{bmatrix} \tag{4}$$

The set point vector S contains the set points LSF, SIM and ALM and is defined as:

$$S=\begin{bmatrix} LSF \\ SIM \\ ALM \end{bmatrix} \tag{5}$$

The weight matrix R is defined as:

$$R=\begin{bmatrix} C \\ S \\ A \\ F \end{bmatrix} \tag{6}$$

wherein C, S, A and F are the weight of CaO, $S_iO_2$, $Al_2O_3$ and $Fe_2O_3$, respectively, and R is derived by multiplying U by P. A function $f$ takes R as input and generates S as output. The function $f$ comprises three simultaneous non-linear equations defined as follows:

$$LSF=\frac{C}{2.8\cdot S+1.18\cdot A+0.6\cdot F} \tag{7)(8)(9}$$

$$SIM=\frac{S}{A+F}$$

$$ALM=\frac{A}{F}$$

where:

$$C=c_1\cdot u_1+c_2\cdot u_2+c_3\cdot(1-u_1-u_2)$$

$$S=s_1\cdot u_1+s_2\cdot u_2+s_3\cdot(1-u_1-u_2)$$

$$A=a_1\cdot u_1+a_2\cdot u_2+a_3\cdot{}^*1-u_1-u_2)$$

$$F=f_1\cdot u_1+f_2\cdot u_2+f_3\cdot(1-u_1-u_2) \tag{10)(11)(12)(13}$$

and $u_1$, $u_2$ and $u_3=1-u_1-u_2$ are the dry basis ratio of limestone, sandstone and sweetener, respectively. Furthermore, $c_i$, $s_i$, $a_i$ and $f_i$ are the chemical elements of process matrix P defined in equation 3.

Referring back to FIG. 2, the gradient-based predictive controller 32 maps ΔS to ΔU. The mapping of ΔS to ΔU is defined as:

$$\Delta U=f\circ\Delta S \tag{14}$$

wherein ○ is a function mapping and $f$ performs the function mapping of the gradient-based predictive controller 32. The open-loop system gradient can then be defined as:

$$\frac{\Delta S}{\Delta U} \tag{15}$$

The open-loop system gradient defined in equation 15 can then be reorganized and represented as follows:

$$R = P\hat{x}U$$

$$S = f\,f(R) \tag{16) (17}$$

wherein $\hat{x}$ represents matrix multiplication, R is the weight matrix, P is the process composition matrix, U is the control variable matrix, and S is the set point matrix.

Assuming that P changes insignificantly between two control iterations, then two gradients, $G_1$ and $G_2$, which calculate the partial derivatives of ΔS with respect to ΔR and ΔR with respect to ΔU, respectively, can be derived and are defined as:

$$\Delta S = G_1\hat{x}\Delta R$$

$$\Delta R = G_2\hat{x}\Delta U \tag{18)(19}$$

wherein ΔS is a 3 by 1 matrix defined as:

$$\Delta S = \begin{bmatrix} \Delta LSF \\ \Delta SIM \\ \Delta ALM \end{bmatrix} \tag{20}$$

ΔR is a 4 by 1 matrix defined as:

$$\Delta R = \begin{bmatrix} \Delta C \\ \Delta S \\ \Delta A \\ \Delta F \end{bmatrix} \tag{21}$$

ΔU is a 2 by 1 matrix defined as:

$$\Delta U = \begin{bmatrix} \Delta u_1 \\ \Delta u_2 \end{bmatrix} \tag{22}$$

$G_1$ is a 3 by 4 matrix defined as:

$$G_1 = \begin{pmatrix} \frac{\partial LSF}{\partial C} & \frac{\partial LSF}{\partial S} & \frac{\partial LSF}{\partial A} & \frac{\partial LSF}{\partial F} \\ \frac{\partial SIM}{\partial C} & \frac{\partial SIM}{\partial S} & \frac{\partial SIM}{\partial A} & \frac{\partial SIM}{\partial F} \\ \frac{\partial ALM}{\partial C} & \frac{\partial ALM}{\partial S} & \frac{\partial ALM}{\partial A} & \frac{\partial ALM}{\partial F} \end{pmatrix} \tag{23}$$

$$= \begin{pmatrix} \frac{1}{(2.8\cdot S + 1.18\cdot A + 0.6\cdot F)} & \frac{-2.8\cdot C}{(2.8\cdot S + 1.18\cdot A + 0.6\cdot F)^2} & \frac{-1.18\cdot C}{(2.8\cdot S + 1.18\cdot A + 0.6\cdot F)^2} & \frac{-0.6\cdot C}{(2.8\cdot S + 1.18\cdot A + 0.6\cdot F)^2} \\ 0 & \frac{1}{A+F} & \frac{-S}{(A+F)^2} & \frac{-S}{(A+F)^2} \\ 0 & 0 & \frac{1}{F} & \frac{-A}{F^2} \end{pmatrix}$$

$G_2$ is a 4 by 2 matrix defined as:

$$G_2 = \begin{pmatrix} \frac{\partial C}{\partial u_1} & \frac{\partial C}{\partial u_2} \\ \frac{\partial S}{\partial u_1} & \frac{\partial S}{\partial u_2} \\ \frac{\partial A}{\partial u_1} & \frac{\partial A}{\partial u_2} \\ \frac{\partial F}{\partial u_1} & \frac{\partial F}{\partial u_2} \end{pmatrix} = \begin{pmatrix} c_1 - c_3 & c_2 - c_3 \\ s_1 - s_3 & s_2 - s_3 \\ a_1 - a_3 & a_2 - a_3 \\ f_1 - f_3 & f_2 - f_3 \end{pmatrix} \tag{24}$$

Note that $C_i$, $s_i$, $a_i$ and $f_i$ are the chemical elements as defined in equation 3. Further, the partial derivatives of ΔS with respect to ΔU can be obtained from:

$$\Delta S = G \otimes \Delta U \Rightarrow \begin{pmatrix} \Delta LSF \\ \Delta SIM \\ \Delta ALM \end{pmatrix} = G \otimes \begin{pmatrix} \Delta u_1 \\ \Delta u_2 \end{pmatrix} \tag{25}$$

where $G = G_1\ \hat{x}\ G_2$ is a 3 by 2 matrix.

As mentioned above, the functionality of the gradient-based controller 32 is to invert the G matrix. More specifically, the functionality is to find $G^{-1}$ such that:

$$\Delta U = G^{-1}\hat{x}\Delta S \tag{25}$$

However, G is not a square matrix and is generally not directly invertible. This results in an over-constrained problem and usually renders its solution to pseudo-inversion or optimization techniques such a least means squares.

Figure 4:
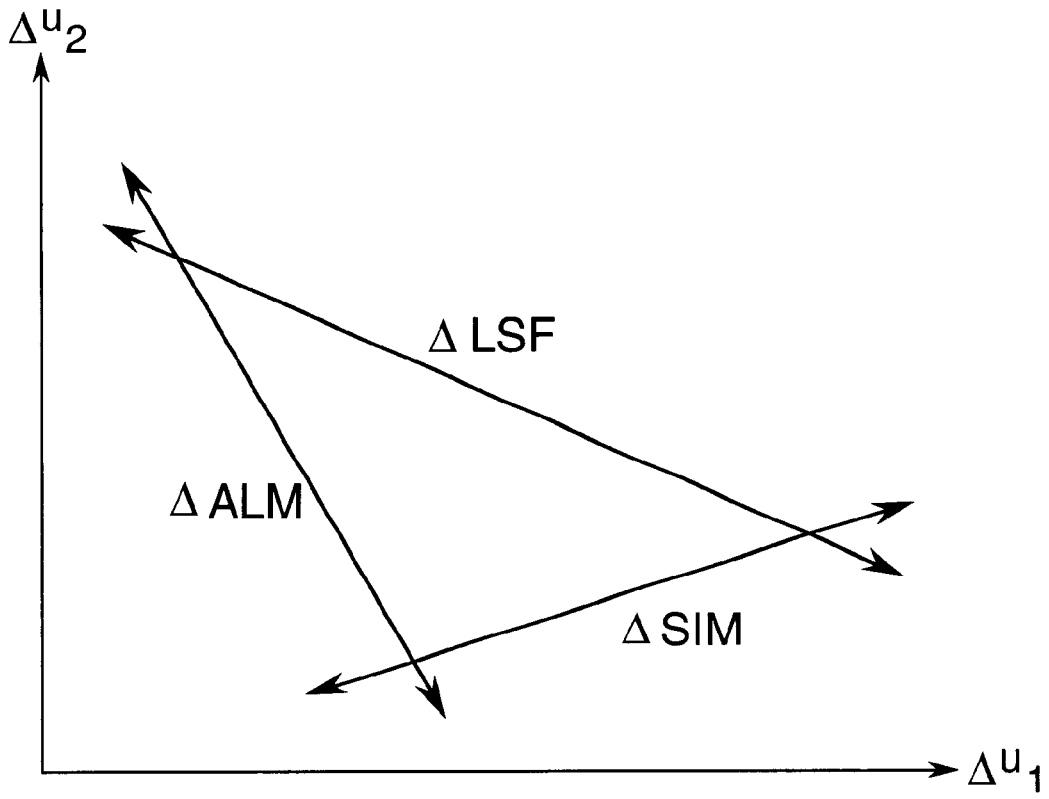
FIG. 4 shows a schematic depicting geometric interpretation of the gradient-based predictive control performed according to this invention.

FIG. 4 shows a schematic depicting geometric interpretation of the gradient-based predictive control performed according to this invention. In particular, FIG. 4 shows three lines lying on a plane in a two-dimensional space. The three lines represent ΔLSF, ΔSIM and ΔALM and are in the two-dimensional space spanned by $\Delta u_1$ and $\Delta u_2$. In FIG. 4 the lines for ΔLSF, ΔSIM and ΔALM are labeled as $\overline{\Delta LSF}$, $\overline{\Delta SIM}$ and $\overline{\Delta ALM}$, respectively. The points on $\overline{\Delta LSF}$ represent the change in control action which is able to bring the system to the change in set point, ΔLSF. Similarly, the points on $\overline{\Delta SIM}$ and $\overline{\Delta ALM}$ represent the change in control actions which are able to bring the system to the change in set points, ΔSIM and ΔALM, respectively.

Reaching the change in three set points simultaneously means that there exists a point on the plane which is on $\overline{\Delta LSF}$, $\overline{\Delta SIM}$ and $\overline{\Delta ALM}$. This can be interpreted as where the sum of distance from the point to the three lines is minimized. Similarly, there will be only two lines on the plane if there are two change in set points. To find a change in control action to reach the two change in set points at the same time is equivalent to finding the point on the plane at which the two lines meet. This again could be interpreted as where the sum of distance from the point to the two lines is minimized. In general, the distance from a point (a change in control action) to a line (a change in set point) can be interpreted as the degree of unreachability for the change in control action to reach the change in set point. The shorter the distance, the greater the degree of reachability. The longer the distance, the less the degree of reachability. In this context, to what degree a change in control action (a point on the plane) drives the system to a specific change in set point (a line on the plane) depends on how far the point is from the line.

In order to provide the gradient-based predictive control according to this invention, the gradient-based predictive controller 32 uses an optimization algorithm to determine a sequence of future controller outputs over a control horizon, such that a specified objective function is minimized. In this invention, the objective function is a modification of the quadratic function which is defined as:

$$\text{minimize } J = \sum_{i=1}^{H} \alpha_i \cdot (S*(k+i) - S(k+1))^2 + \sum_{i=1}^{H_c} \beta_i \cdot \Delta U(k+i-1)^2 \tag{27}$$

$$\text{s.t. } \Delta S = G \otimes \Delta U$$

$$U(k+1) = U(k) + \Delta U(k)$$

$$S = f(P, U)$$

$$U = [U^l, U^u]$$

wherein J is the objective function to be minimized, S* and S are the target and the actual set points, respectively, H and $H_c$ are the prediction and control horizons, respectively, $\alpha$ and $\beta$ define the weighting of the tracking error and the control effort with respect to each other and with respect to time, k is the current time step, i is the time step index, $\Delta S$ is defined in equation 25, $f(\cdot)$ represents the functionality of the open-loop system, P is the process composition matrix, and $U^1$ and $U^u$ are the lower and upper bounds of $\Delta U$, respectively.

In essence, the first term of J minimizes the tracking error and the second term of J minimizes control jockeying in order to provide smooth changes in control as opposed to abrupt changes. Thus, J seeks a balance between minimizing tracking error and maintaining smooth control, while the tradeoff is controlled by $\alpha$ and $\beta$. Note that it is not possible to satisfy all three equations in equation 25 simultaneously. At most, two out of the three can be satisfied at the same time. It is therefore, up to the choice of the user, which depends on the priority of the set points. Furthermore, only the first control U(k) is applied to the system and the optimization is repeated at the next time step k+1, which known as the receding horizon principle.

In this invention, MATLAB, a well-known scientific computing software, is used for fast prototyping and simulation of the constrained optimization. MATLAB's non-linear constrained optimization routines use a Sequential Quadratic Programming (SQP) method which is a form of gradient descent, which finds a local optima to the problem. To find the local optima it is assumed that the objective function and constraints are non-linear. The explicit constraints are assumed to be inequality constraints since the parameters are bounded from below and above. The objective function is approximated by a quadratic function. This is done by approximating its Hessian at the current point. The non-linear constraints are linearly approximated locally. The approximation produces a quadratic programming problem, which can be solved by any of several standard methods. The solution is used to form a new iterate for the next step. The step length to the next point is determined by a line search, such that a sufficient decrease in the objective function is obtained. The Hessian and constraint planes are then updated appropriately and this method is iterated until there is no appropriate non-zero step length to be found.

Figure 5:
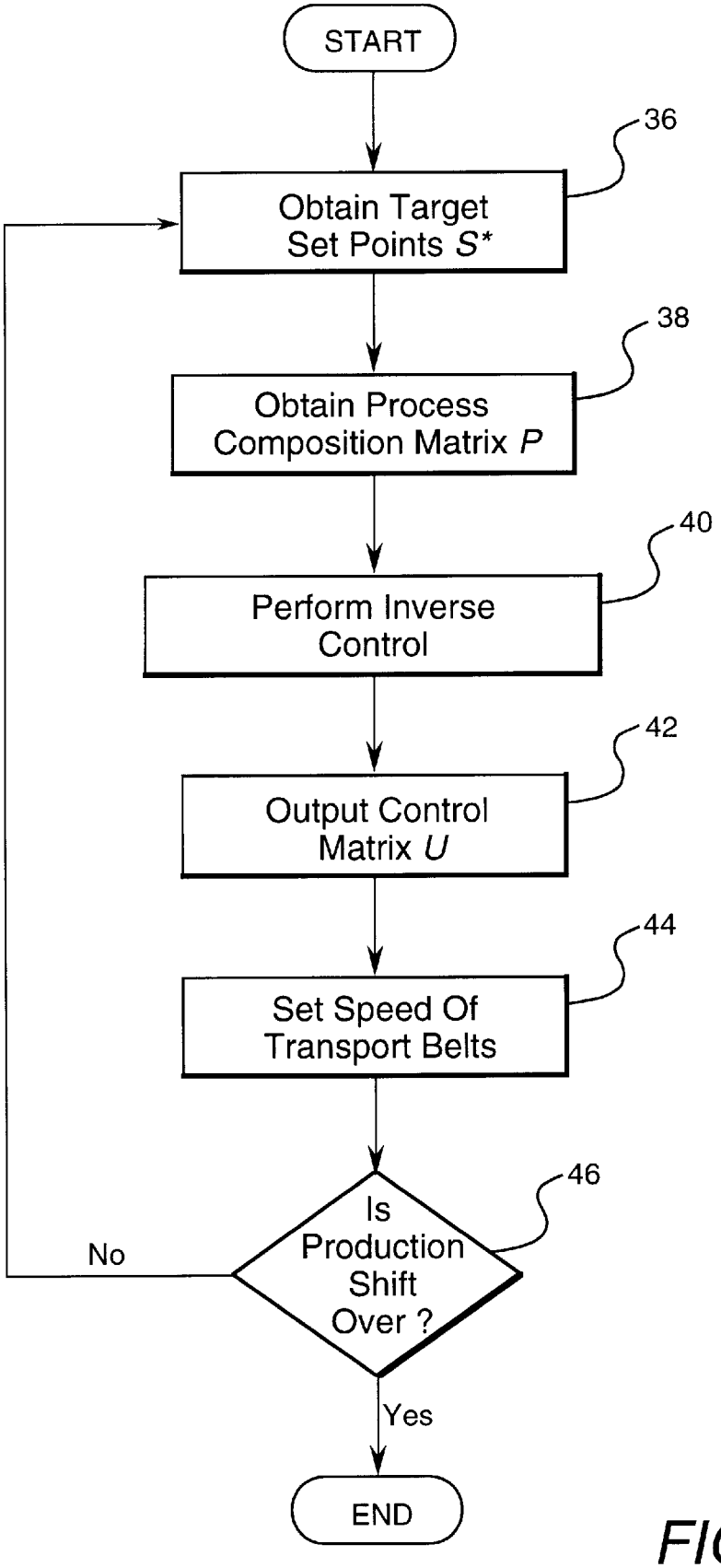
FIG. 5 shows a flow chart setting forth the steps of using gradient-based predictive control to provide raw mix proportioning according to this invention.

FIG. 5 shows a flow chart describing the raw mix proportioning control of this invention. Initially, the raw mix proportioning controller obtains a plurality of target set points S* at 36. Next, the raw mix proportioning controller obtains the process composition matrix P at 38. The raw mix proportioning controller then performs the gradient-based predictive control by using the above described optimization at 40. The raw mix proportioning controller then outputs the control matrix U at 42 which is the proportion of raw materials. The raw mix proportioning controller then sets the speed of each of the transport belts to provide the proper proportion of raw material at 44 which is in accordance with the control matrix U. These steps continue until the end of the production shift. If there is still more time left in the production shift as determined at 46, then steps 36–44 are repeated, otherwise, the process ends.

It is therefore apparent that there has been provided in accordance with the present invention, a system and method for providing raw mix proportioning control in a cement plant with a gradient-based predictive controller that fully satisfy the aims and advantages and objectives hereinbefore set forth. The invention has been described with reference to several embodiments, however, it will be appreciated that variations and modifications can be effected by a person of ordinary skill in the art without departing from the scope of the invention.

What is claimed is:

1. A system for providing raw mix proportioning control in a cement plant, comprising:

a plurality of raw material;

a plurality of transport belts for transporting the plurality of raw material;

a measuring device that measures the composition of the plurality of raw material transported by the plurality of transport belts;

a raw mix proportioning controller, coupled to the plurality of transport belts and the measuring device, for controlling the proportions of the plurality of raw material transported along the plurality of transport belts, wherein the raw mix proportioning controller comprises a gradient-based predictive controller that uses a plurality of target set points and the composition of the plurality of raw material as inputs and generates a control action to each of the plurality of transport belts that is representative of the proportions of the material to be transported along the belt, wherein the gradient-based predictive controller determines a sequence of future control outputs over a control horizon to generate the control action; and a mixer, coupled to the plurality of transport belts, for mixing the proportions of each of the plurality of raw material transported therefrom.

2. The system according to claim 1, wherein the plurality of raw material comprise limestone, sandstone and sweetener.

3. The system according to claim 1, wherein the plurality of target set points are physical properties comprising lime saturation factor, alumina modulus and silica modulus.

4. The system according to claim 1, wherein the gradient-based predictive controller performs a non-linear constrained optimization.

5. The system according to claim 4, wherein the gradient-based predictive controller minimizes a specified objective function to minimize tracking error and control jockeying.

6. The system according to claim 1, wherein the system further comprises a raw mill, coupled to the mixer for grinding and blending the mix of the plurality of raw material into a raw mix.

7. The system according to claim 6, wherein the system further comprises a kiln, coupled to the raw mill for burning the raw mix.

8. The system according to claim 1, wherein the gradient-based predictive controller performs a geometric interpretation between the plurality of target set points and the composition of the plurality of raw material.

9. A method for providing raw mix proportioning control in a cement plant, comprising:

providing a plurality of raw material;

transporting the plurality of raw material with a plurality of transport belts to a mixer;

controlling the proportions of the plurality of raw material transported along the plurality of transport belts to the mixer, comprising:

obtaining a plurality of target set points;

obtaining the composition of the plurality of raw material;

performing gradient-based predictive control on the plurality of target set points and the composition of the plurality of raw material, wherein the gradient-based predictive control comprises determining a sequence of future controller outputs over a control horizon; and determining the proportions of the plurality of raw material transported along the plurality of transport belts to the mixer according to the gradient-based predictive control; and mixing the determined proportions of the plurality of raw material with the mixer.

10. The method according to claim 9, further comprising providing the mix of the plurality of raw material from the mixer to a raw mill and generating a raw mix therefrom.

11. The method according to claim 10, further comprising providing the raw mix from the raw mill to a kiln.

12. The method according to claim 9, wherein performing the gradient-based predictive control comprises performing a non-linear constrained optimization.

13. The method according to claim 12, wherein the performing of the gradient-based predictive control further comprises minimizing a specified objective function to minimize tracking error and control jockeying.

14. The method according to claim 9, wherein the plurality of raw material comprise limestone, sandstone and sweetener.

15. The method according to claim 9, wherein the plurality of target set points are physical properties comprising lime saturation factor, alumina modulus and silica modulus.

16. The method according to claim 9, wherein the performing of the gradient-based predictive control comprises performing a geometric interpretation between the plurality of target set points and the composition of the plurality of raw material.

* * * * *